US006085530A

United States Patent [19]

Barito

[11] Patent Number: 6,085,530

[45] Date of Patent: Jul. 11, 2000

[54] DISCHARGE TEMPERATURE SENSOR FOR SEALED COMPRESSOR

[75] Inventor: Thomas R. Barito, Arkadelphia, Ark.

[73] Assignee: Scroll Technologies, Arkadelphia, Ark.

[21] Appl. No.: 09/206,832

[22] Filed: Dec. 7, 1998

[51] Int. Cl.[7] ..... F25B 49/02

[52] U.S. Cl. ..... 62/126; 62/129; 361/22; 417/32

[58] Field of Search ..... 62/126, 129, 228.1, 62/228.3, 161; 361/22; 417/32

[56] References Cited

U.S. PATENT DOCUMENTS

| | | | |
|---|---|---|---|
| 3,619,722 | 11/1971 | Gill et al. | 62/161 X |
| 3,765,191 | 10/1973 | Canter | 62/228.1 |
| 4,265,091 | 5/1981 | Kobayashi | 62/129 X |
| 5,076,067 | 12/1991 | Prenger et al. | 62/126 X |
| 5,241,833 | 9/1993 | Ohkoshi | 62/129 X |
| 5,452,989 | 9/1995 | Rood et al. | 417/29 |
| 5,586,445 | 12/1996 | Bessler | 62/129 X |

*Primary Examiner*—Harry B. Tanner
*Attorney, Agent, or Firm*—Howard & Howard

[57] ABSTRACT

A sensor is provided for monitoring temperatures within a discharge tube on a scroll compressor. If the temperature is too high, this is an indication of the loss of charge situation. When the temperature on the discharge tube exceeds the temperature indicative of a loss of charge, then the motor is stopped. In one embodiment, a heat fusible link melts when the temperature is exceeded and sends a signal to a control to stop the motor. A repair person must then visit the compressor and repair the compressor before it can be restarted. In this way, the system provides a very inexpensive control for eliminating operation of the compressor and its associated refrigeration system in a loss of charge situation.

8 Claims, 1 Drawing Sheet

DISCHARGE TEMPERATURE SENSOR FOR SEALED COMPRESSOR

BACKGROUND OF THE INVENTION

This invention relates to a safety device for stopping operation of a sealed compressor upon a loss of charge.

Sealed compressors are utilized in many refrigerant compressor applications. Typically, a canister is sealed in a fluid-tight manner, and an electric motor and compressor pump unit are placed within the canister. Refrigerant circulated within the canister includes sections at both suction and discharge pressure. As an example, a discharge plenum is typically formed near one end of the compression canister, and between and end cap and a canister body. Also, the suction fluid is often allowed to circulate within the canister to cool the motor, or perform other functions.

With these types of compressors, loss of refrigerant charge may occur by leaking. When the amount of refrigerant in the system decreases below the expected amount, the temperature at the discharge end of the compressor increases dramatically.

Various expensive safeguards are included into the compressor and its associated controls to identify this occurrence.

It is the goal of this invention to simplify the types of safety devices included for identifying a loss of charge situation and for protecting the compressor.

SUMMARY OF THE INVENTION

In a disclosed embodiment of this invention, a sealed compressor is provided with an element which is actuated upon an increase of temperature to stop operation of the compressor. Preferably, some element which is actuated upon an increased temperature in the discharge end of the compressor shuts down operation of the motor. The element is preferably of the type which must be manually reset. Should there be a loss of charge occurrence in the operation of the compressor, the temperature of the discharge tube will increase.

In one embodiment, a heat fusible element is connected to either the discharge plenum end cap housing or the discharge tube. The heat fusible element melts when the temperature increases above a predesigned temperature, and provides a signal to an electrical control that then stops motor operation. The compressor cannot be restarted until a repair person is directed to the compressor to replace the portions of the compressor which are causing the loss of charge. In this way, a simple device is utilized to provide a very reliable safety control.

Other types of control elements such as a resizable switch may replace the heat fusible element. It is the main goal of this invention that a control simply be actuated to stop compressor operation in a loss of charge situation. In a preferred embodiment, the sealed compressor incorporates a scroll compressor These and other features of the present invention can be best understood from the following specification and drawings.

DETAILED DESCRIPTION OF A PREFERRED EMBODIMENT

Figure 1:
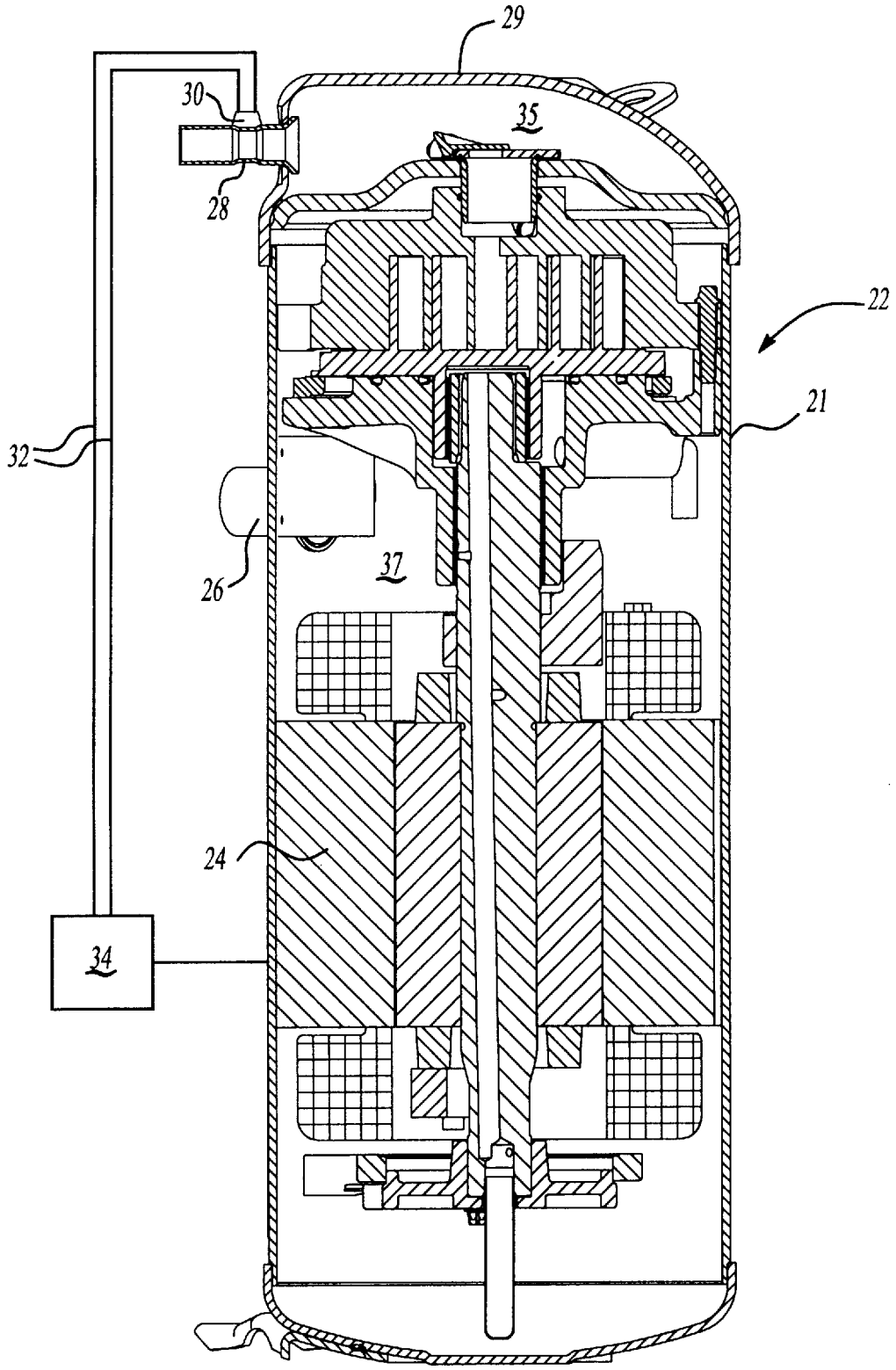
FIG. 1 is a schematic view of a compressor incorporating the present invention.

FIG. 1 shows a sealed compressor 20 having a compressor canister 21 providing a sealed enclosure for a compressor pump unit 22 and an associated motor 24. As shown schematically, the compressor pump unit 22 is a scroll compressor.

A suction inlet 26 delivers suction fluid into the canister 21 and a discharge tube 28 delivers fluid from the canister 21. End cap 29 seals the canister 21 adjacent the discharge end, as known. A discharge pressure chamber 35 is shown above the scroll pump unit, and a suction pressure chamber 37 is generally defined below. The heat fusible element is placed on the canister at some area exposed to the discharge pressure in chamber 35.

In a preferred embodiment of this invention, heat fusible element 30, is associated with control wires 32 which extend to a control 34. The heat fusible element is selected such that it will not melt until a predetermined temperature is reached which is indicative of a loss of charge occurrence within the canister 21. That is, the heat fusible element 30 will not melt unless the conditions within the compressor are such that due to the heat at the discharge tube 28 it is likely that the compressor canister 21 has allowed the refrigerant to leak, depleting the charge of refrigerant within the canister. Of course, this compressor is incorporated into a refrigerant cycle, and the leakage can occur anywhere in the refrigerant cycle.

In such a condition, the heat fusible element 30 melts. This sends a signal through the control wires 32 to the control 34 that the motor 24 should be stopped. The control is preferably operable such that the compressor cannot be restarted until a service call is made to the compressor. Thus, the charge can be checked, or the compressor replaced should there be a leakage problem.

Although a heat fusible element is shown, it should be understood that other types of controls such as a resettable switch may replace the heat fusible element. Also, known heat fusible elements are available which are appropriate for this application.

The appropriate controls necessary for achieving the motor control, as shown in the black box 34, are well within the scope of a worker in this art. It is the application of such control which is the inventive aspect of this invention.

Preferred embodiments of this invention have been disclosed; however, a worker of ordinary skill in this art would recognize that certain modifications come within the scope of this invention. For that reason, the following claims should be studied to determine the true scope and content of this invention.

What is claimed is:

1. A method of monitoring a sealed compressor comprising:

providing a sealed compressor canister housing a motor and compressor into a refrigerant system, and providing a charge of refrigerant within said refrigerant system;

placing a sensor adjacent a discharge end of said compressor to monitor a condition of the compressor indicative of the amount of refrigerant charge within said system said sensor being provided by a heat fusible link;

sending a signal to a control to stop operation of said motor should said sensor determine that there is an inadequate supply of refrigerant within said compressor system said heat fusible link melting when a predetermined temperature is reached to send said signal; and stopping operation of said motor until a service call is made.

2. A method as recited in claim 1, wherein said compressor is a scroll compressor.

3. A method as recited in claim 1, wherein said sensor is placed on a discharge tube.

4. A compressor comprising:

a sealed canister;

a compressor unit and an electric motor for driving said compressor unit placed within said sealed canister;

a discharge pressure portion of said sealed canister and a suction pressure portion of said sealed canister; and a sensor for monitoring conditions within said canister, said sensor being placed on a portion of said canister at discharge pressure, said sensor being operable to identify a loss of refrigerant within said canister and send a signal to a control, said control being operable to shut down said motor for said compressor if a signal is received, said sensor requiring manual resetting to re-start said motor after said shut down occurs.

5. A compressor as recited in claim 4, wherein said compressor unit is a scroll compressor unit.

6. A compressor as recited in claim 4, wherein said sensor is a heat fusible element, which melts when a predetermined design temperature is reached.

7. A compressor as recited in claim 6, wherein said heat fusible element is mounted on a discharge tube.

8. A compressor comprising:

a sealed canister;

a compressor unit and an electric motor for driving said compressor unit placed within said sealed canister;

a discharge pressure portion of said sealed canister and a suction pressure portion of said sealed canister; and a sensor for monitoring conditions within said canister, said sensor being placed on a portion of said canister at discharge pressure, said sensor being operable to identify a loss of refrigerant within said canister and send a signal to a control, said control being operable to shut down said motor for said compressor if a signal is received, said sensor being a heat fusible element which melts when a predetermined design temperature is reached.

* * * * *